US011114079B2

(12) United States Patent
Li et al.

(10) Patent No.: US 11,114,079 B2
(45) Date of Patent: Sep. 7, 2021

(54) INTERACTIVE MUSIC AUDITION METHOD, APPARATUS AND TERMINAL

(71) Applicant: Baidu Online Network Technology (Beijing) Co., Ltd, Beijing (CN)

(72) Inventors: Jianlong Li, Beijing (CN); Shiquan Ye, Beijing (CN); Xiangtao Jiang, Beijing (CN); Hao Yang, Beijing (CN); Zhendong Ma, Beijing (CN); Huajian Liu, Beijing (CN)

(73) Assignee: Baidu Online Network Technology (Beijing) Co., Ltd., Beijing (CN)

( * ) Notice: Subject to any disclaimer, the term of this patent is extended or adjusted under 35 U.S.C. 154(b) by 0 days.

(21) Appl. No.: 16/687,316

(22) Filed: Nov. 18, 2019

(65) Prior Publication Data

US 2020/0349912 A1 Nov. 5, 2020

(30) Foreign Application Priority Data

Apr. 30, 2019 (CN) ..... 201910363124.9

(51) Int. Cl.
*G10H 1/36* (2006.01)
*G10H 1/00* (2006.01)

(52) U.S. Cl.
CPC ..... *G10H 1/361* (2013.01); *G10H 1/0025* (2013.01); *G10H 2220/011* (2013.01); *G10H 2220/106* (2013.01)

(58) Field of Classification Search
CPC ..... G10H 1/36; G10H 2220/011; G10H 2220/106; G10H 1/361; G10H 1/0025;
(Continued)

(56) References Cited

U.S. PATENT DOCUMENTS 6,917,911 B2 * 7/2005 Schultz ..... H04M 3/493 704/206
8,344,233 B2 * 1/2013 Cai ..... G10H 1/0058 700/94

(Continued)

FOREIGN PATENT DOCUMENTS

CN 103400593 2/2016
CN 106888154 6/2017

(Continued)

OTHER PUBLICATIONS

"Amazon Music customers can now talk to Alexa more naturally", Dec. 6, 2018 (Year: 2018).*

(Continued)

*Primary Examiner* — Marlon T Fletcher
(74) *Attorney, Agent, or Firm* — William C. Schrot; Jeffrey I. Auerbach; AuerbachSchrot LLC

(57) ABSTRACT

An interactive music audition method, apparatus and terminal are provided. The method includes: generating audition inquiry information according to audition requirement information, wherein the audition inquiry information includes a plurality of audition music options associated with the audition requirement information; generating a plurality of audition inquiry voices corresponding to the respective audition music options based on the audition inquiry information, and playing the generated audition inquiry voices; acquiring music selection information for the generated audition inquiry voices; and playing audition music according to the music selection information. Not only the interaction experience between a user and a smart device is improved, but also the accuracy of mining a user's interest is increased.

9 Claims, 6 Drawing Sheets

(58) Field of Classification Search
CPC ..... G10H 2210/061; G10H 2240/145; G10L 25/54; G10K 15/04
See application file for complete search history.

(56) References Cited

U.S. PATENT DOCUMENTS

| | | | | |
|---|---|---|---|---|
| 10,283,138 | B2 * | 5/2019 | Mixter | G10L 25/84 |
| 10,304,463 | B2 * | 5/2019 | Mixter | G10L 17/04 |
| 10,319,365 | B1 * | 6/2019 | Nicolis | G10L 13/10 |
| 10,355,658 | B1 * | 7/2019 | Yang | H04R 3/00 |
| 10,445,365 | B2 * | 10/2019 | Luke | H04L 65/602 |
| 10,466,959 | B1 * | 11/2019 | Yang | G10L 25/51 |
| 10,482,904 | B1 * | 11/2019 | Hardie | G10L 15/22 |
| 10,504,520 | B1 * | 12/2019 | Roy | G10L 17/22 |
| 10,599,390 | B1 * | 3/2020 | Brahmbhatt | G06F 3/165 |
| 10,636,418 | B2 * | 4/2020 | Badr | G06F 16/90335 |
| 10,713,289 | B1 * | 7/2020 | Mishra | G06F 40/30 |
| 2018/0054506 | A1 * | 2/2018 | Hart | H04M 1/271 |
| 2018/0091913 | A1 * | 3/2018 | Hartung | H03G 3/32 |
| 2019/0035397 | A1 * | 1/2019 | Reily | G06F 3/165 |
| 2019/0043492 | A1 * | 2/2019 | Lang | G10L 15/22 |
| 2019/0066670 | A1 * | 2/2019 | White | G10L 15/1815 |
| 2019/0102145 | A1 * | 4/2019 | Wilberding | H04L 12/282 |
| 2019/0103849 | A1 * | 4/2019 | Shaya | H04R 29/001 |
| 2020/0074994 | A1 * | 3/2020 | Igarashi | G10L 15/22 |
| 2020/0090068 | A1 * | 3/2020 | Brett | G06N 5/047 |

FOREIGN PATENT DOCUMENTS

| | | |
|---|---|---|
| CN | 107247769 | 10/2017 |
| CN | 108399269 | 8/2018 |
| CN | 109376265 | 2/2019 |
| CN | 104750818 | 3/2019 |
| JP | 2006-202127 A | 8/2006 |
| JP | 2017-084313 A | 5/2017 |
| JP | 2018-055440 A | 4/2018 |
| JP | 2019-040603 A | 3/2019 |
| WO | WO 2018/212885 A1 | 11/2018 |

OTHER PUBLICATIONS

"Amazon Echo" (Year: 2019).*

JP 2019-203680 Notice of Reasons for Refusal; dated Dec. 15, 2020; 5 pages (including English translation).

* cited by examiner

INTERACTIVE MUSIC AUDITION METHOD, APPARATUS AND TERMINAL

CROSS-REFERENCE TO RELATED APPLICATION

This application claims priority to Chinese patent application No. 201910363124.9, filed on Apr. 30, 2019, which is hereby incorporated by reference in its entirety.

TECHNICAL FIELD

The present application relates to relates to a field of smart device technology, and particularly, to an interactive music audition method, apparatus and terminal.

BACKGROUND

At present, a user may usually request a smart device to provide a piece of audition music. However, the interactions between the smart device and the user are not sufficient, resulting in a poor audition result, which may not meet the user's requirement. For example, in the case where a user sends an instruction "I want to trial listening a theme song of a movie" to a smart playing device, the smart playing device not only often fails to provide multiple audition songs as recommendations according to the user's requirement, but also fails to receive the user's feedback on the audition songs, thereby resulting in monotonous audition results and poor audition experience.

SUMMARY

An interactive music audition method, apparatus and terminal are provided according to embodiments of the present application, so as to at least solve the above technical problems in the existing technology.

In a first aspect, an interactive music audition method is provided according an embodiment of the present application. The method includes:

generating audition inquiry information according to audition requirement information, wherein the audition inquiry information includes a plurality of audition music options associated with the audition requirement information;

generating a plurality of audition inquiry voices corresponding to the respective audition music options based on the audition inquiry information, and playing the generated audition inquiry voices;

acquiring music selection information for the generated audition inquiry voices; and playing audition music according to the music selection information.

In an implementation, the generating audition inquiry information according to audition requirement information includes:

acquiring the audition requirement information;

selecting the plurality of audition music options associated with the audition requirement information, according to a preset recommendation strategy; and generating the audition inquiry information according to the plurality of audition music options.

In an implementation, each of the audition music options includes at least one audition music list, and the playing audition music according to the music selection information includes:

extracting an audition music option corresponding to the music selection information;

retrieving an audition music list of the extracted audition music option; and selecting at least one piece of music from the retrieved audition music list playing the selected at least one piece of music as the audition music.

In an implementation, after the playing audition music according to the music selection information, the method further includes:

acquiring audition feedback information on the audition music;

continuing playing the audition music, in response to audition feedback information for indicating a satisfaction with the audition music; and generating a new audition inquiry voice, in response to audition feedback information for indicating a dissatisfaction with the audition music.

In a second aspect, an interactive music audition apparatus is provided according an embodiment of the present application. The apparatus includes:

an audition inquiry information generation module, configured to generate audition inquiry information according to audition requirement information, wherein the audition inquiry information includes a plurality of audition music options associated with the audition requirement information;

an audition inquiry voice playing module, configured to generate a plurality of audition inquiry voices corresponding to the respective audition music options based on the audition inquiry information, and play the generated audition inquiry voices;

a music selection information acquisition module, configured to acquire music selection information for the generated audition inquiry voices; and an audition music playing module, configured to play audition music according to the music selection information.

In an implementation, the audition inquiry information generation module includes:

an audition requirement information acquisition unit, configured to acquire the audition requirement information;

an audition music option selection unit, configured to select the plurality of audition music options associated with the audition requirement information, according to a preset recommendation strategy; and an audition inquiry information generation unit, configured to generate the audition inquiry information according to the plurality of audition music options.

In an implementation, each of the audition music options includes at least one audition music list, and the audition music playing module includes:

an audition music option extraction unit, configured to extract an audition music option corresponding to the music selection information;

an audition music list retrieving unit, configured to retrieve an audition music list of the extracted audition music option; and an audition music playing unit, configured to select at least one piece of music from the retrieved audition music list and play the selected at least one piece of music as the audition music.

In an implementation, the apparatus further includes:

an audition music feedback module, configured to acquire audition feedback information on the audition music; continue playing the audition music, in response to audition feedback information for indicating a satisfaction with the audition music; and generate a new audition inquiry voice, in response to audition feedback information for indicating a dissatisfaction with the audition music.

The functions of the apparatus may be implemented by using hardware or by corresponding software executed by hardware. The hardware or software includes one or more modules corresponding to the functions described above.

In a possible embodiment, the interactive music audition apparatus structurally includes a processor and a memory, wherein the memory is configured to store a program which supports the interactive music audition apparatus in executing the interactive music audition method described in the first aspect. The processor is configured to execute the program stored in the memory. The interactive music audition apparatus may further include a communication interface through which the interactive music audition apparatus communicates with other devices or communication networks.

In a third aspect, a computer-readable storage medium for storing computer software instructions used for an interactive music audition apparatus is provided. The computer readable storage medium may include programs involved in executing of the interactive music audition method described above in the first aspect.

One of the above technical solutions has the following advantages or beneficial effects: through voice interaction between a user and a smart playing device, the user's interest in certain music may be continuously and deeply explored. In the process of exploration, the user's interest in certain music may be more accurately captured via an audition mode, thereby not only improving the user's experience of interacting with a smart device, but also improving the accuracy of exploring a user's interest.

The above summary is provided only for illustration and is not intended to be limiting in any way. In addition to the illustrative aspects, embodiments, and features described above, further aspects, embodiments, and features of the present application will be readily understood from the following detailed description with reference to the accompanying drawings.

BRIEF DESCRIPTION OF THE DRAWINGS

In the drawings, unless otherwise specified, identical or similar parts or elements are denoted by identical reference numerals throughout the drawings. The drawings are not necessarily drawn to scale. It should be understood these drawings merely illustrate some embodiments of the present application and should not be construed as limiting the scope of the present application.

DETAILED DESCRIPTION OF THE EMBODIMENTS

Hereafter, only certain exemplary embodiments are briefly described. As can be appreciated by those skilled in the art, the described embodiments may be modified in different ways, without departing from the spirit or scope of the present application. Accordingly, the drawings and the description should be considered as illustrative in nature instead of being restrictive.

Embodiment 1

Figure 1:
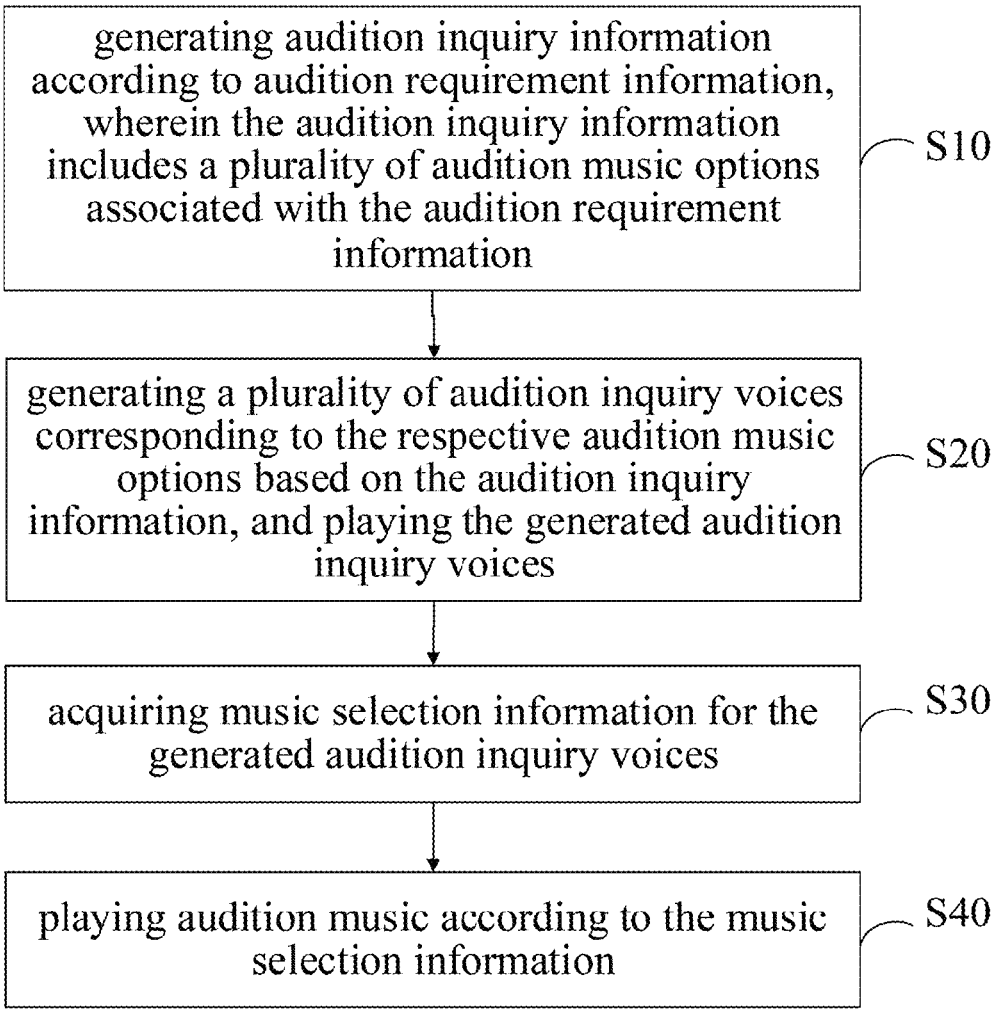
FIG. 1 is a schematic flowchart showing an interactive music audition method according to an embodiment of the present application.

In a specific embodiment, as illustrated in FIG. 1, an interactive music audition method is provided. The method includes following steps.

In S10, audition inquiry information is generated according to audition requirement information, wherein the audition inquiry information includes a plurality of audition music options associated with the audition requirement information.

In S20, a plurality of audition inquiry voices corresponding to the respective audition music options are generated based on the audition inquiry information, and the generated audition inquiry voices are played.

In S30, music selection information for the generated audition inquiry voices are acquired.

In S42, audition music is played according to the music selection information.

In an example, the interactive music audition method provided by embodiments of the present application is applicable to a smart playing device, such as a smart speaker, a smart watch, a smart vehicle-mounted player, a mobile phone, and an IPAD. When receiving a wake-up voice uttered by a user, such as "Xiaodu, Xiaodu", a smart playing device may be woken up. After being woken up, the smart playing device may receive an audition requirement voice uttered by the user. Thereafter, an audition inquiry voice associated with the audition requirement voice may be played. Then, the smart playing device may acquire an audition selection voice uttered by the user associated with the audition inquiry voice. At this time, an audition mode is entered. Then, and the smart playing device may send the received audition requirement voice and the audition selection voice to a server for parsing, so as to obtain audition requirement information.

For example, a user utters an audition requirement voice "I want to listen to a cheerful song". A smart music device may play an audition inquiry voice associated with the audition requirement voice "which one do you want to listen to, Chinese, English or Korean?", that is, the smart music device inquiries whether a cheerful Chinese song, a cheerful English song or a cheerful Korean song should be played for the user. Then, the user may feedback an audition selection voice "I want to listen to a Chinese song". At this time, an audition mode is entered. Then, the smart playing device may send the received audition requirement voice "I want to listen to a cheerful song" and the audition selection voice "I want to listen to a Chinese song" to a server. The server may parse the audition requirement voice "I want to listen to a cheerful song" and the audition selection voice "I want to listen to a Chinese song", to obtain audition requirement information, that is, the user wants to listen to a cheerful Chinese song.

In the server, audition inquiry information is generated according to the audition requirement information, wherein the audition inquiry information includes a plurality of audition music options associated with the audition requirement information. A plurality of audition music options associated with the audition requirement information may be preset and stored in the server. For example, the audition requirement information is that the user wants to listen to a cheerful Chinese song, and the associated plurality of audition music options may include cheerful Chinese pop songs, cheerful Cantonese pop songs, and the like. Then, the server sends the audition inquiry information to the smart playing device, and the smart playing device generates a plurality of audition inquiry voices based on the audition inquiry information and plays the generated audition inquiry voices. For example, a played audition inquiry voice may be "do you want to listen to a Chinese pop song or a Cantonese pop song?".

After the smart playing device plays an audition inquiry voice, in the case where the user feeds back a piece of selected music related to an option in the audition inquiry voice, the smart playing device may receive the music selection voice associated with the audition inquiry voice.

Then, the smart playing device sends the music selection voice to the server, and the server may parse music selection information from the music selection voice and send the music selection information to the music playing device. For example, a music selection voice received by a smart music device may be "I select a Chinese pop song", and the music selection information parsed out by the server may include selecting a Chinese pop song.

Finally, the smart playing device may play the audition music associated with the music selection information after receiving the music selection information parsed out by the server. After parsing out the music selection information, in the case that the audition music is to be played, the smart playing device may intercept a chorus part of the audition music familiar to the public and play this part. For example, the chorus part of Jay Chou's "Nunchaku" may be played.

After trial listening first audition music, the user may provide a feedback on the audition music. The smart playing device may record the user's feedback on the audition music to explore and determine the user's interest. If the user's interest may not be determined after one round of audition, the smart playing device may perform multiple rounds of auditions until feedback information for indicating a satisfaction of the user with the audition music is received. After receiving feedback information for indicating a satisfaction of the user with the audition music, the smart playing device may end the audition mode, enter a music playlist and play music in the list. Through voice interaction between a user and a smart playing device, the user's interest in certain music may be continuously and deeply explored. In the process of exploration, the user's interest in certain music may be more accurately captured via an audition mode, thereby not only improving the user's experience of interacting with a smart device, but also improving the accuracy of exploring a user's interest.

Figure 2:
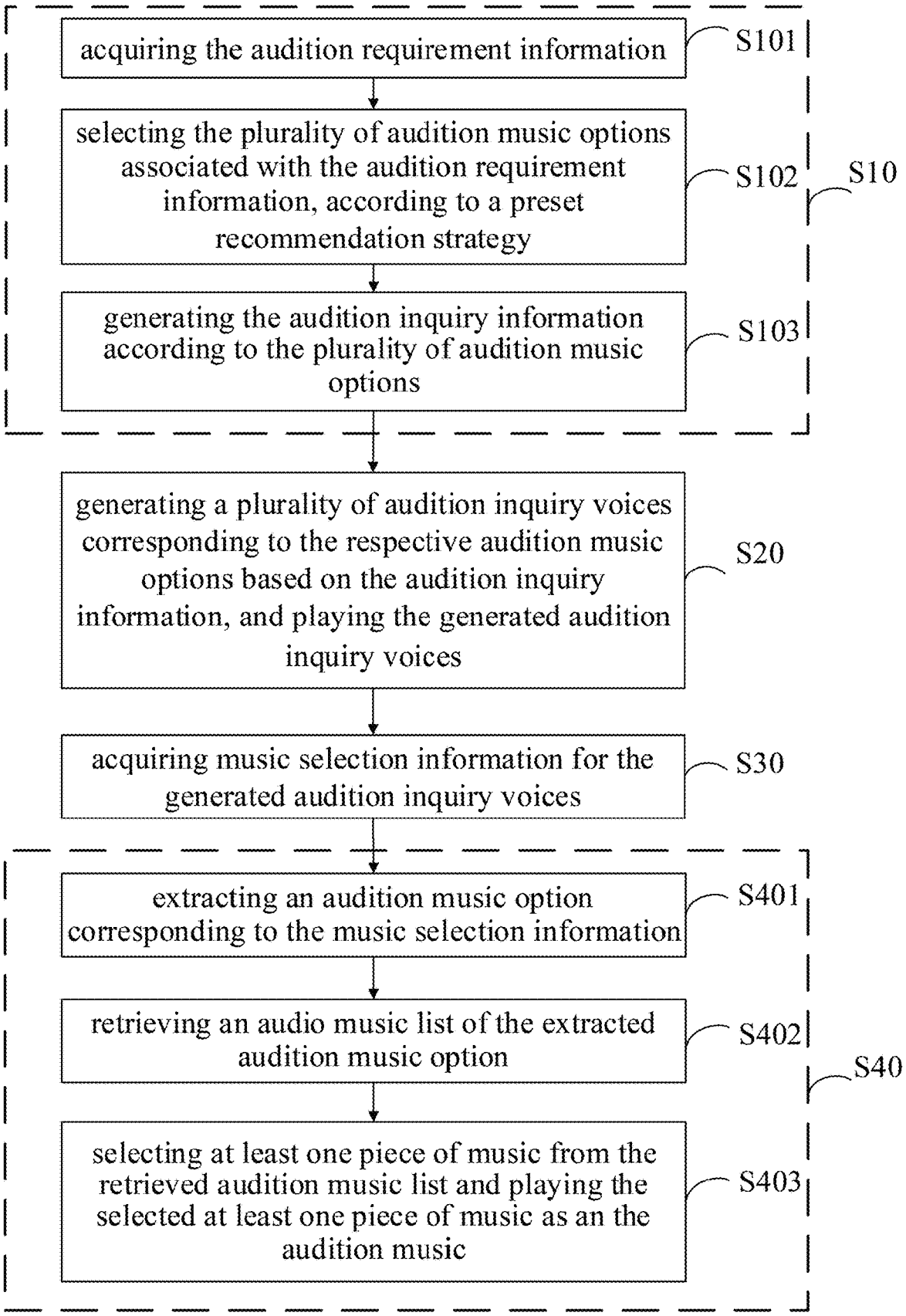
FIG. 2 is a schematic flowchart showing another interactive music audition method according to an embodiment of the present application.

In an implementation, as illustrated in FIG. 2, the generating audition inquiry information according to audition requirement information in S10 includes following steps.

In S101, the audition requirement information is acquired.

In S102, the plurality of audition music options associated with the audition requirement information are selected according to a preset recommendation strategy.

In S103, the audition inquiry information is generated according to the plurality of audition music options.

In an example, audition requirement information may be obtained, after a smart playing device explores a user's general requirement to a certain extent. A preset recommendation strategy may be a preset corresponding relation between audition requirement information and an audition music option. Alternatively, the preset recommendation strategy may be a statistically calculated corresponding relation between audition requirement information and an audition music option by continuously recording a user's selection of audition music. The preset recommendation strategy may be stored in a server. Same audition requirement information may be associated with various types of audition music options. For example, in the case where audition requirement information indicates that soothing classical music is to be played, the associated audition music options may be those music options classified according to composers, such as Schubert classical music, Beethoven classical music, and Bach classical music. Alternatively, the audition music options may also be those music options classified according to musical instruments, such as classical music played by a cello, classical music played by a violin, and classical music played by a Chinese zither. For example, an audition inquiry voice played by a smart playing device may be "do you want to listen to songs in a music option classified according to composers, or songs in a music option classified according to musical instruments?".

In an implementation, as illustrated in FIG. 2, each of the audition music options includes at least one audition music list, and the playing audition music according to the music selection information in S40 includes following steps.

In S401, an audition music option corresponding to the music selection information is extracted.

In S402, an audition music list of the extracted audition music option is retrieved.

In S403, at least one piece of music is selected from the retrieved audition music list, and the selected at least one piece of music is played as the audition music.

In an example, in the server, in the case where the music selection information is associated with multiple music options classified according to composers, the music options classified according to composers are extracted, and a plurality of audition music lists included in the music options classified according to composers are retrieved, wherein the music options classified according to composers may include a Schubert classical music list, a Beethoven classical music list, a Bach classical music list, and the like. Then, one piece of music may be randomly selected from the list and played as first audition music. For example, a first piece of music in the Bach classical music list may be selected as the first audition music. For another example, in the case where the music selection information is associated with multiple music options classified according to musical instruments, the music options classified according to musical instruments are extracted, and a plurality of audition music lists included in the music options classified according to musical instruments are retrieved, wherein the music options classified according to musical instruments may include a cello classical music list, a violin classical music list, and a Chinese zither classical music list. For example, according to a user's habit, a work of Yo-Yo Ma in the cello classical music list may be selected as the audition music.

Figure 3:
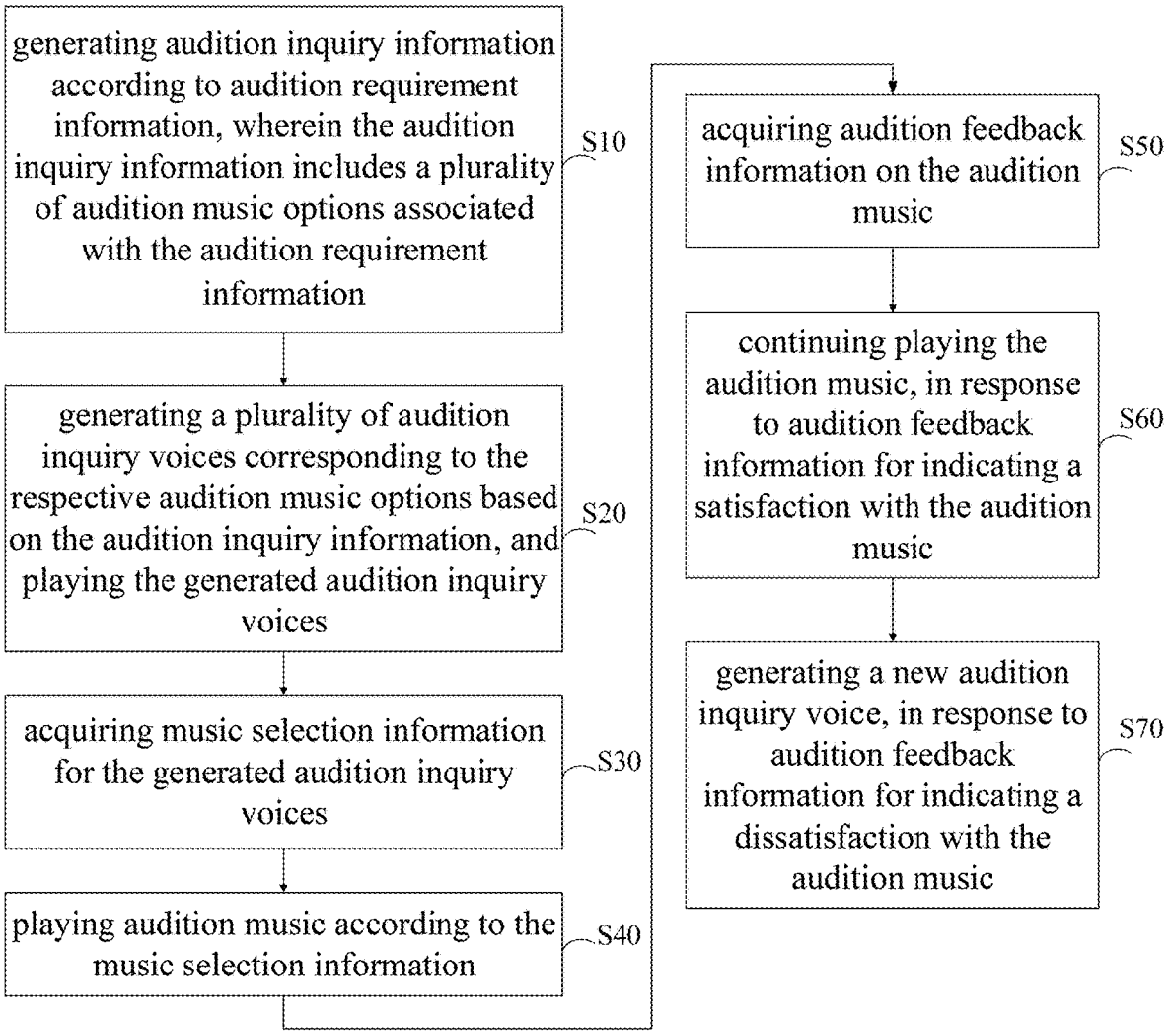
FIG. 3 is a schematic flowchart showing yet another interactive music audition method according to an embodiment of the present application.

In an implementation, as illustrated in FIG. 3, after the playing audition music according to the music selection information in S40, the method further includes following steps.

In S50, audition feedback information on the audition music is acquired.

In S60, the audition music is continued playing, in response to audition feedback information for indicating a satisfaction with the audition music.

In S70, a new audition inquiry voice is generated, in response to audition feedback information for indicating a dissatisfaction with the audition music.

In an example, in a first round of audition, a smart playback device may pause after starting to play audition music, and then play a feedback inquiry voice, such as "how do you like in the Schubert classical music list?'. The user's feedback on audition music may be classified into two types. One is affirmative feedbacks, for example, the smart playing device may receive a feedback voice of "very pleasant". In the case where audition feedback information for indicating a satisfaction with the audition music is received, the current audition music may be continued playing. The other is negative feedbacks, for example, the smart playing device may receive a feedback voice of "unpleasant". In the case where audition feedback information for indicating a dissatisfaction with the audition music is received, a new audition inquiry voice may be generated, and a second round of audition may be started. For example, the smart playing device may generate an audition inquiry voice "okay, would you like to trial listening music in the Beethoven classical music list instead? If you still do not like it, you are supposed to instruct me to change another music list." Then, the smart playing device may continue to receive a new selection from the user, until the audition is ended

Embodiment 2

Figure 4:
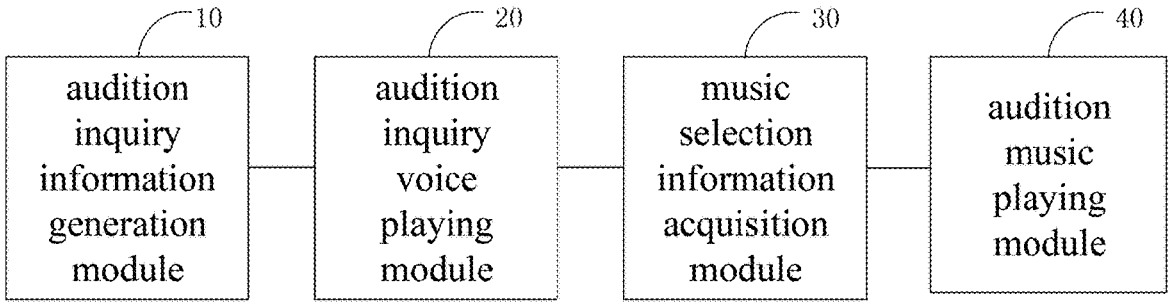
FIG. 4 is a schematic structural block diagram showing an interactive music audition apparatus according to an embodiment of the present application.

In another specific embodiment, as illustrated in FIG. 4, an interactive music audition apparatus is provided. The apparatus includes:

an audition inquiry information generation module 10, configured to generate audition inquiry information according to audition requirement information, wherein the audition inquiry information includes a plurality of audition music options associated with the audition requirement information;

an audition inquiry voice playing module 20, configured to generate a plurality of audition inquiry voices corresponding to the respective audition music options based on the audition inquiry information, and play the generated audition inquiry voices;

a music selection information acquisition module 30, configured to acquire music selection information for the generated audition inquiry voices; and an audition music playing module 40, configured to play audition music according to the music selection information.

Figure 5:
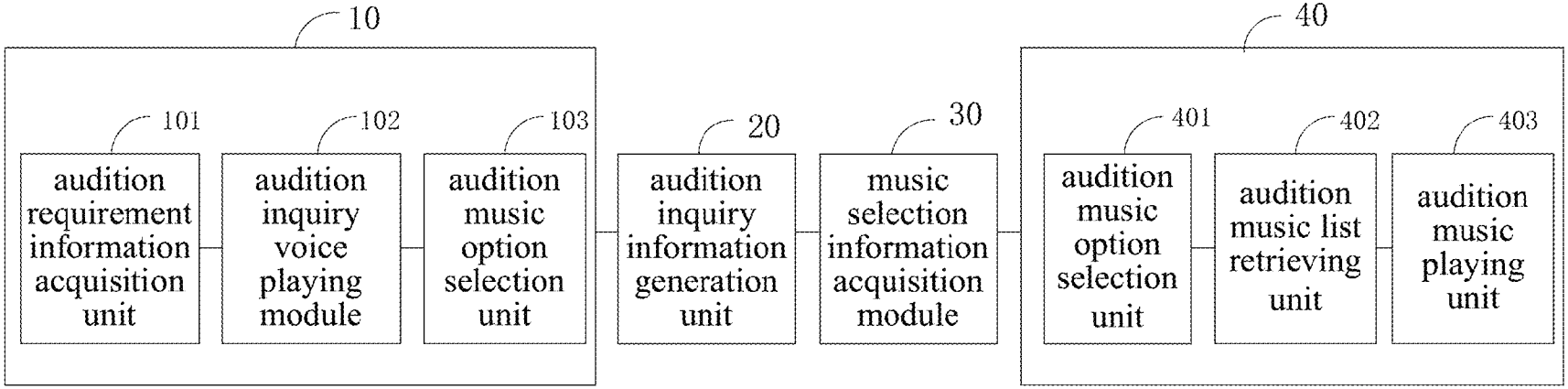
FIG. 5 is a schematic structural block diagram showing an interactive music audition apparatus according to an embodiment of the present application.

In an implementation, as illustrated in FIG. 5, the audition inquiry information generation module 10 includes:

an audition requirement information acquisition unit 101, configured to acquire the audition requirement information;

an audition music option selection unit 102, configured to select the plurality of audition music options associated with the audition requirement information, according to a preset recommendation strategy; and an audition inquiry information generation unit 103, configured to generate the audition inquiry information according to the plurality of audition music options.

In an implementation, as illustrated in FIG. 5, each of the audition music options includes at least one audition music list, and the audition music playing module 40 includes:

an audition music option extraction unit 401, configured to extract an audition music option corresponding to the music selection information;

an audition music list retrieving unit 402, configured to retrieve an audition music list of the extracted audition music option; and an audition music playing unit 403, configured to select at least one piece of music from the retrieved audition music list and play the selected at least one piece of music as the audition music.

Figure 6:
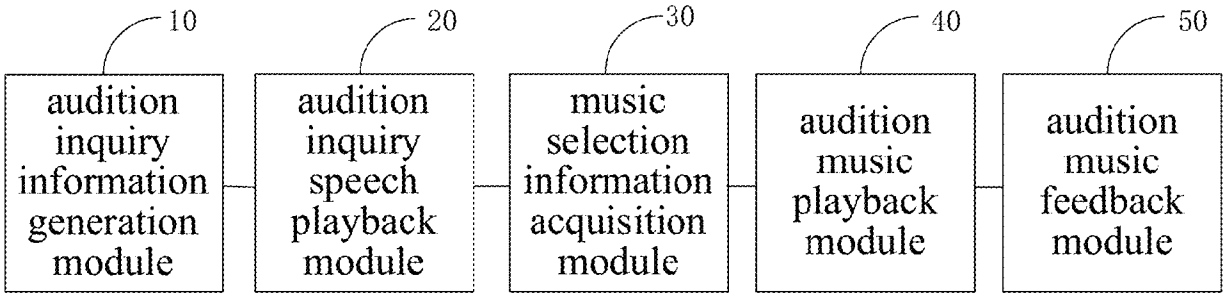
FIG. 6 is a schematic structural block diagram showing an interactive music audition apparatus according to an embodiment of the present application.

In an implementation, as illustrated in FIG. 6, the apparatus further includes:

an audition music feedback module 50, configured to acquire audition feedback information on the audition music; continue playing the audition music, in response to audition feedback information for indicating a satisfaction with the audition music; and generate a new audition inquiry voice, in response to audition feedback information for indicating a dissatisfaction with the audition music.

In this embodiment, functions of modules in the apparatus refer to the corresponding description of the method mentioned above and thus a detailed description thereof is omitted herein.

Embodiment 3

Figure 7:
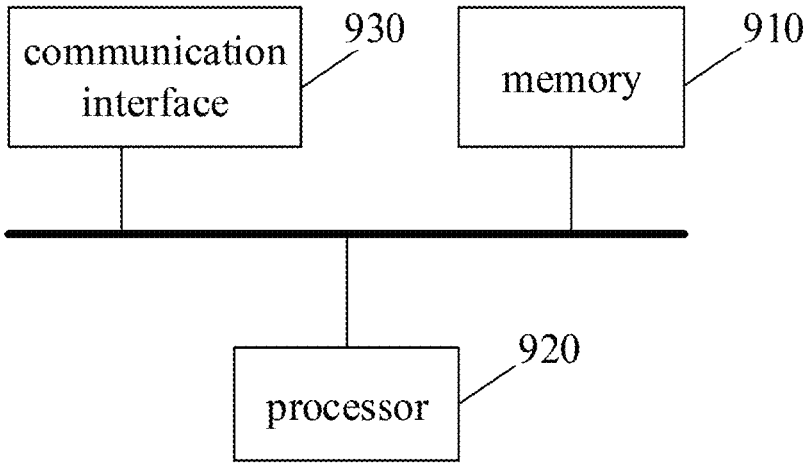
FIG. 7 is a schematic structural block diagram showing an interactive music audition terminal according to an embodiment of the present application.

FIG. 7 is a schematic structural block diagram showing an interactive music audition terminal according to an embodiment of the present application. As illustrated in FIG. 7, the terminal includes a memory 910 and a processor 920, wherein a computer program that can run on the processor 920 is stored in the memory 910. The processor 920 executes the computer program to implement the interactive music audition method according to foregoing embodiments. The number of either the memory 910 or the processor 920 may be one or more.

The terminal further includes a communication interface 930 configured to enable the memory 910 and the processor 920 to communicate with an external device and exchange data.

The memory 910 may include a high-speed RAM memory and may also include a non-volatile memory, such as at least one magnetic disk memory.

If the memory 910, the processor 920, and the communication interface 930 are implemented independently, the memory 910, the processor 920, and the communication interface 930 may be connected to each other via a bus to realize mutual communication. The bus may be an Industry Standard Architecture (ISA) bus, a Peripheral Component Interconnected (PCI) bus, an Extended Industry Standard Architecture (EISA) bus, or the like. The bus may be categorized into an address bus, a data bus, a control bus, and the like. For ease of illustration, only one bold line is shown in FIG. 7 to represent the bus, but it does not mean that there is only one bus or one type of bus.

Optionally, in a specific implementation, if the memory 910, the processor 920 and the communication interface 930 are integrated on one chip, the memory 910, the processor 920 and the communication interface 930 may implement mutual communication through an internal interface.

In the description of the specification, the description of the terms "one embodiment," "some embodiments," "an example," "a specific example," or "some examples" and the like means the specific features, structures, materials, or characteristics described in connection with the embodiment or example are included in at least one embodiment or example of the present application. Furthermore, the specific features, structures, materials, or characteristics described may be combined in any suitable manner in any one or more of the embodiments or examples. In addition, different embodiments or examples described in this specification and features of different embodiments or examples may be incorporated and combined by those skilled in the art without mutual contradiction.

In addition, the terms "first" and "second" are used for descriptive purposes only and are not to be construed as indicating or implying relative importance or implicitly indicating the number of indicated technical features. Thus, features defining "first" and "second" may explicitly or implicitly include at least one of the features. In the description of the present application, "a plurality of" means two or more, unless expressly limited otherwise.

Any process or method descriptions described in flowcharts or otherwise herein may be understood as representing modules, segments or portions of code that include one or more executable instructions for implementing the steps of a particular logic function or process. The scope of the preferred embodiments of the present application includes additional implementations where the functions may not be performed in the order shown or discussed, including according to the functions involved, in substantially simultaneous or in reverse order, which should be understood by those skilled in the art to which the embodiment of the present application belongs.

Logic and/or steps, which are represented in the flowcharts or otherwise described herein, for example, may be thought of as a sequencing listing of executable instructions for implementing logic functions, which may be embodied in any computer-readable medium, for use by or in connection with an instruction execution system, device, or apparatus (such as a computer-based system, a processor-included system, or other system that fetch instructions from an instruction execution system, device, or apparatus and execute the instructions). For the purposes of this specification, a "computer-readable medium" may be any device that may contain, store, communicate, propagate, or transport the program for use by or in connection with the instruction execution system, device, or apparatus. More specific examples (not a non-exhaustive list) of the computer-readable media include the following: electrical connections (electronic devices) having one or more wires, a portable computer disk cartridge (magnetic device), random access memory (RAM), read only memory (ROM), erasable programmable read only memory (EPROM or flash memory), optical fiber devices, and portable read only memory (CDROM). In addition, the computer-readable medium may even be paper or other suitable medium upon which the program may be printed, as it may be read, for example, by optical scanning of the paper or other medium, followed by editing, interpretation or, where appropriate, process otherwise to electronically obtain the program, which is then stored in a computer memory.

It should be understood various portions of the present application may be implemented by hardware, software, firmware, or a combination thereof. In the above embodiments, multiple steps or methods may be implemented in software or firmware stored in memory and executed by a suitable instruction execution system. For example, if implemented in hardware, as in another embodiment, they may be implemented using any one or a combination of the following techniques well known in the art: discrete logic circuits having a logic gate circuit for implementing logic functions on data signals, application specific integrated circuits with suitable combinational logic gate circuits, programmable gate arrays (PGAs), field programmable gate arrays (FPGAs), and the like.

Those skilled in the art may understand that all or some of the steps carried in the methods in the foregoing embodiments may be implemented by a program instructing relevant hardware. The program may be stored in a computer-readable storage medium, and when executed, one of the steps of the method embodiment or a combination thereof is included.

In addition, each of the functional units in the embodiments of the present application may be integrated in one processing module, or each of the units may exist alone physically, or two or more units may be integrated in one module. The above-mentioned integrated module may be implemented in the form of hardware or in the form of software functional module. When the integrated module is implemented in the form of a software functional module and is sold or used as an independent product, the integrated module may also be stored in a computer-readable storage medium. The storage medium may be a read only memory, a magnetic disk, an optical disk, or the like.

The foregoing descriptions are merely specific embodiments of the present application, but not intended to limit the protection scope of the present application. Those skilled in the art may easily conceive of various changes or modifications within the technical scope disclosed herein, all these should be covered within the protection scope of the present application. Therefore, the protection scope of the present application should be subject to the protection scope of the claims.

What is claimed is:

1. An interactive music audition method, comprising:

acquiring an audition requirement information;

selecting a plurality of audition music options associated with the audition requirement information, according to a preset recommendation strategy;

generating an audition inquiry information according to the plurality of audition music options;

generating a plurality of audition inquiry voices corresponding to the respective audition music options based on the audition inquiry information, and playing the generated audition inquiry voices;

acquiring music selection information for the generated audition inquiry voices; and playing audition music according to the music selection information.

2. The interactive music audition method according to claim 1, wherein each of the audition music options comprises at least one audition music list, and the playing audition music according to the music selection information comprises:

extracting an audition music option corresponding to the music selection information;

retrieving an audition music list of the extracted audition music option; and selecting at least one piece of music from the retrieved audition music list and playing the selected at least one piece of music as the audition music.

3. The interactive music audition method according to claim 1, wherein after the playing audition music according to the music selection information, the method further comprises:

acquiring audition feedback information on the audition music;

continuing playing the audition music, in response to audition feedback information for indicating a satisfaction with the audition music; and generating a new audition inquiry voice, in response to audition feedback information for indicating a dissatisfaction with the audition music.

4. An interactive music audition apparatus, comprising:

one or more processors; and a memory for storing one or more programs, wherein the one or more programs are executed by the one or more processors to enable the one or more processors to:

acquire an audition requirement information;

select a plurality of audition music options associated with the audition requirement information, according to a preset recommendation strategy;

generate an audition inquiry information according to the plurality of audition music options;

generate a plurality of audition inquiry voices corresponding to the respective audition music options based on the audition inquiry information, and play the generated audition inquiry voices;

acquire music selection information for the generated audition inquiry voices; and play audition music according to the music selection information.

5. The interactive music audition apparatus according to claim 4, wherein each of the audition music options comprises at least one audition music list, and wherein the one or more programs are executed by the one or more processors to enable the one or more processors to:

extract an audition music option corresponding to the music selection information;

retrieve an audition music list of the extracted audition music option; and select at least one piece of music from the retrieved audition music list and play the selected at least one piece of music as the audition music.

6. The interactive music audition apparatus according to claim 4, wherein the one or more programs are executed by the one or more processors to enable the one or more processors to:

acquire audition feedback information on the audition music; continue playing the audition music, in response to audition feedback information for indicating a satisfaction with the audition music; and generate a new audition inquiry voice, in response to audition feedback information for indicating a dissatisfaction with the audition music.

7. A non-transitory computer-readable storage medium, in which a computer program is stored, wherein the computer program, when executed by a processor, causes the processor to:

acquire an audition requirement information;

select a plurality of audition music options associated with the audition requirement information, according to a preset recommendation strategy;

generate an audition inquiry information according to the plurality of audition music options;

generate a plurality of audition inquiry voices corresponding to the respective audition music options based on the audition inquiry information, and playing the generated audition inquiry voices;

acquire music selection information for the generated audition inquiry voices; and play audition music according to the music selection information.

8. The non-transitory computer-readable storage medium according to claim 7, wherein the computer program, when executed by a processor, causes the processor to:

extract an audition music option corresponding to the music selection information;

retrieve an audition music list of the extracted audition music option; and select at least one piece of music from the retrieved audition music list and playing the selected at least one piece of music as the audition music.

9. The non-transitory computer-readable storage medium according to claim 7, wherein the computer program, when executed by a processor, causes the processor to:

acquire audition feedback information on the audition music;

continue playing the audition music, in response to audition feedback information for indicating a satisfaction with the audition music; and generate a new audition inquiry voice, in response to audition feedback information for indicating a dissatisfaction with the audition music.

* * * * *